US010365076B1

(12) United States Patent
Cauley, Jr. et al.

(10) Patent No.: US 10,365,076 B1
(45) Date of Patent: Jul. 30, 2019

(54) AMMUNITION CASE PRIMER POCKET SWAGER

(71) Applicant: BATTENFELD TECHNOLOGIES, INC., Columbia, MO (US)

(72) Inventors: Dennis W. Cauley, Jr., Booneville, MO (US); James Tayon, Moberly, MO (US); Michael Cottrell, Columbia, MO (US); Timothy Kinney, Warrenton, MO (US); James Gianladis, Harrisburg, MO (US); Michael Poehlman, Columbia, MO (US); Mark Dalton, Columbia, MO (US); Matthew Kinamore, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 15/873,613

(22) Filed: Jan. 17, 2018

(51) Int. Cl.
*F42B 33/04* (2006.01)
*F42B 33/10* (2006.01)

(52) U.S. Cl.
CPC ..... *F42B 33/04* (2013.01); *F42B 33/10* (2013.01)

(58) Field of Classification Search
CPC ..... F42B 33/04; F42B 33/10; B21K 21/04
USPC ..... 86/36, 37, 38
See application file for complete search history.

(56) References Cited

U.S. PATENT DOCUMENTS 3,054,322 A * 9/1962 Corcoran ..... F42B 33/004 86/23
3,087,372 A * 4/1963 Mittlesteadt ..... F42B 33/02 86/25
3,138,055 A * 6/1964 Weston ..... F42B 33/04 86/36
4,163,410 A * 8/1979 Dillon ..... F42B 33/004 86/23
4,332,185 A * 6/1982 Hargrove ..... F42B 33/04 86/23
4,526,084 A * 7/1985 David ..... F42B 33/04 86/24
4,566,366 A * 1/1986 Lee ..... F42B 33/04 86/24
4,620,472 A * 11/1986 Dillon ..... F42B 33/04 86/25
4,732,073 A 3/1988 Semon
5,649,464 A * 7/1997 Gracey ..... F42B 33/10 408/224

(Continued)

OTHER PUBLICATIONS

RCBS, Precisioneered Reloading Equipment, Primer Pocket Swager—Bench Tool, 8 pages, Jan. 2012.

(Continued)

*Primary Examiner* — Bret Hayes
(74) *Attorney, Agent, or Firm* — Stinson LLP

(57) ABSTRACT

An ammunition case primer pocket swager and associated methods. An actuator of the primer pocket swager may be operatively connected to a swage head for driving the swage head to a swaging position to swage the primer pocket, and may be operatively connected to a case holder for moving the case holder from a loading position to an operational position to hold the case to be swaged. Lost motion in a drive train of the primer pocket swager can be used to position the case holder in the operational position before the swage head reaches the swaging position. A primer pocket swager can include an adjustable case holder stop, a pivot mount guide, and/or a case aligner.

21 Claims, 9 Drawing Sheets

(56) References Cited

U.S. PATENT DOCUMENTS

| | | | | |
|---|---|---|---|---|
| 5,698,809 | A * | 12/1997 | Holt | F42B 33/04 86/24 |
| 9,494,398 | B2 | 11/2016 | Czebiniak | |
| 2016/0209193 | A1 * | 7/2016 | Poehlman | F42B 33/04 |

OTHER PUBLICATIONS

Super Swage 600 (20095): Reloading: Case Preparation Equipment at Dillon Precision, 4 pages, Internet accessed Sep. 5, 2017.
UniqueTek "Tips" File #17: "Swaging Crimped Primer Pockets", 11 pages, Aug. 2016.
Make your Dillon Super Swage 600 Automatic!, ar15.com, 4 pages, Internet accessed Sep. 5, 2017.

* cited by examiner

AMMUNITION CASE PRIMER POCKET SWAGER

FIELD

The present disclosure generally relates to ammunition reloading, and more particularly to a primer pocket swager for swaging primer pockets in ammunition cases.

BACKGROUND

Centerfire ammunition cartridges generally include a case, a bullet seated in a mouth of the case, a propellant inside the case, and a primer seated in the primer pocket of the case for igniting the propellant. In some cartridges, the primer pocket is crimped to secure the primer in the primer pocket. The crimp is usually made by deforming a side wall of the primer pocket inward to protrude against the primer. After such a cartridge is fired, if it is desired to reload the case, the primer pocket usually needs to be swaged to prepare the primer pocket for receipt of a new primer. Sometimes uncrimped cases are swaged to properly size the primer pockets. Various devices are known for swaging primer pockets. In general, a swaging pin is pushed into the primer pocket. A head of the swaging pin is sized to expand the crimped portion of the primer pocket to provide the primer pocket with a relatively smooth side wall. Insertion of the new primer is then much easier and reloading results are improved.

SUMMARY

In one aspect, a primer pocket swager is for swaging a primer pocket of an ammunition case. The primer pocket swager includes and a case holder. The case holder is supported by the frame and is movable with respect to the frame between a loading position and an operational position. The case holder in the loading position being oriented to receive the case on the case holder. The case holder in the operational position being oriented to hold the case in position to be swaged. The case holder being configured to carry the case from the loading position to the operational position. The primer pocket swager includes a swage head supported by the frame. The swage head is sized and shaped to swage the primer pocket of the case. The swage head is movable between a retracted position and a swaging position to swage the primer pocket when the case holder is in the operational position. The primer pocket swager includes an actuator supported by the frame. The actuator is movable with respect to the frame in an actuating stroke from a home position to an actuated position. The actuator is operatively connected to the case holder such that the actuator drives the case holder to the operational position in the actuating stroke. The actuator is operatively connected to the swage head such that the actuator drives the swage head to the swaging position to swage the primer pocket In another aspect, a primer pocket swager includes a frame and a case holder supported by the frame. The case holder is configured to hold the case in position to be swaged. A swage shaft is supported by the frame. The swage shaft has a first swage head located at a first end of the swage shaft and a second swage head smaller than the first swage head located at a second end of the swage shaft opposite the first end. The swage shaft is movable from a retracted position to a swaging position. At least one of the first and second swage heads is oriented to swage the primer pocket when the swage shaft is in the swaging position. An actuator is supported by the frame and movable with respect to the frame in an actuating stroke from a home position toward an actuated position. The actuator is operatively connected to the first swage head such that movement of the actuator in the actuating stroke drives the swage shaft toward the swaging position to swage the primer pocket.

In yet another aspect, a primer pocket swager includes a frame and a pivot mount supported by and pivotable with respect to the frame. A case holder is secured to the pivot mount and is configured to hold the case in position to be swaged. The pivot mount has a track. A pivot mount guide includes a follower biased against the pivot mount. The follower is configured to ride the track on the pivot mount during pivoting of the pivot mount. A swage head is supported by the frame. The swage head is movable from a retracted position to a swaging position and configured to swage the primer pocket in the swaging position. An actuator supported by the frame is movable with respect to the frame and operatively connected to the swage head to drive the swage head toward the swaging position to swage the primer pocket.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
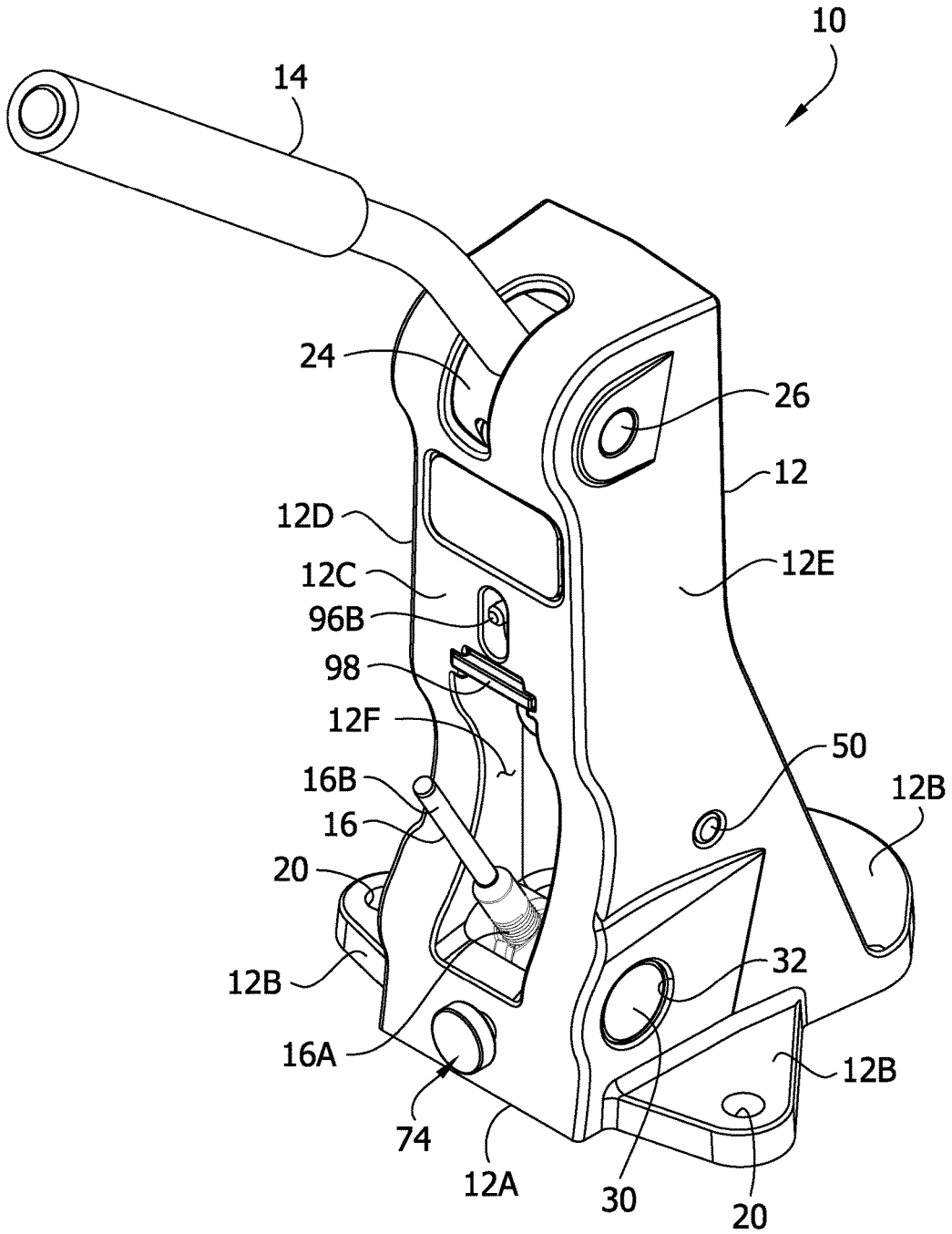
FIG. 1 is a perspective of a primer pocket swager.
Figure 1A:
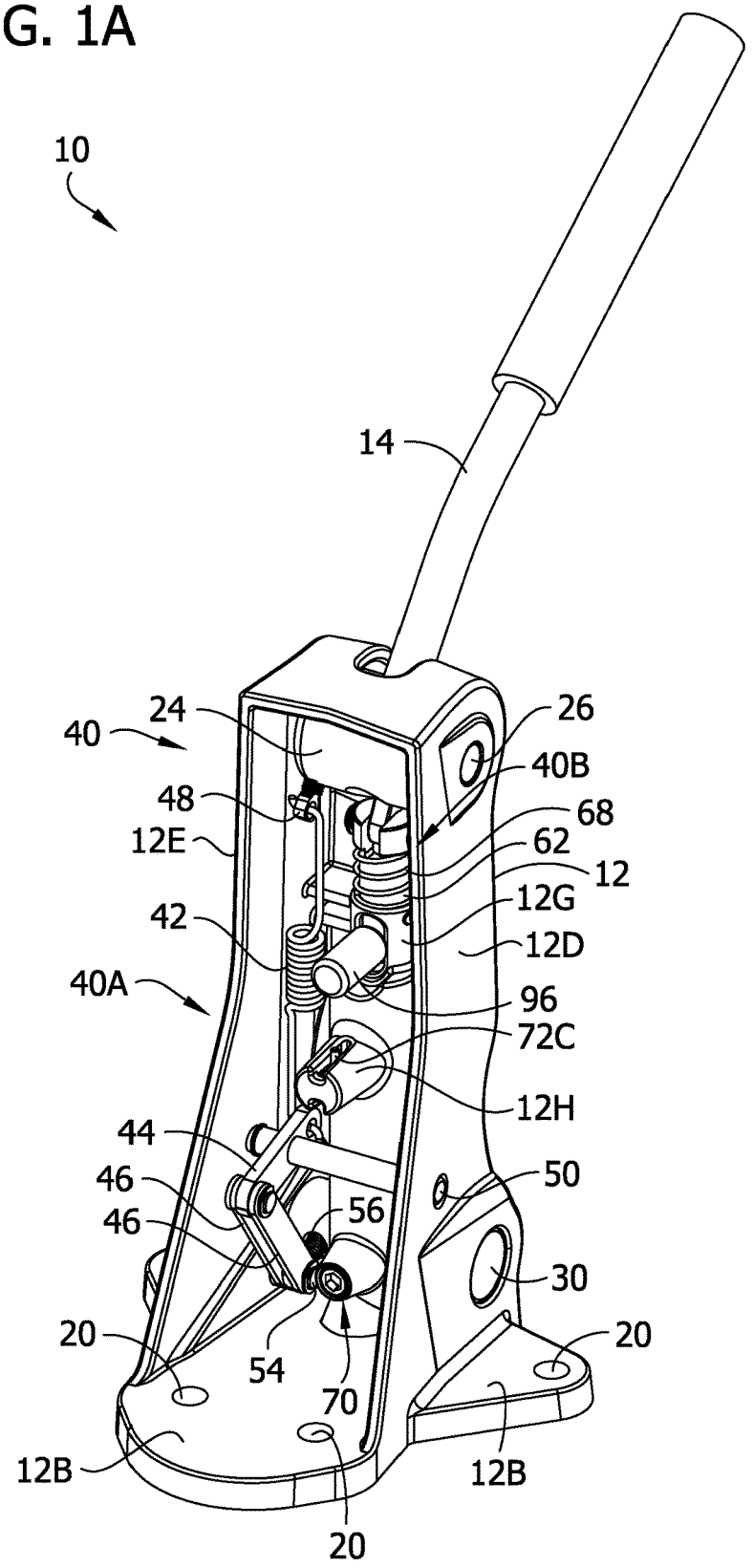
FIG. 1A is a rear elevation of the primer pocket swager.
Figure 2:
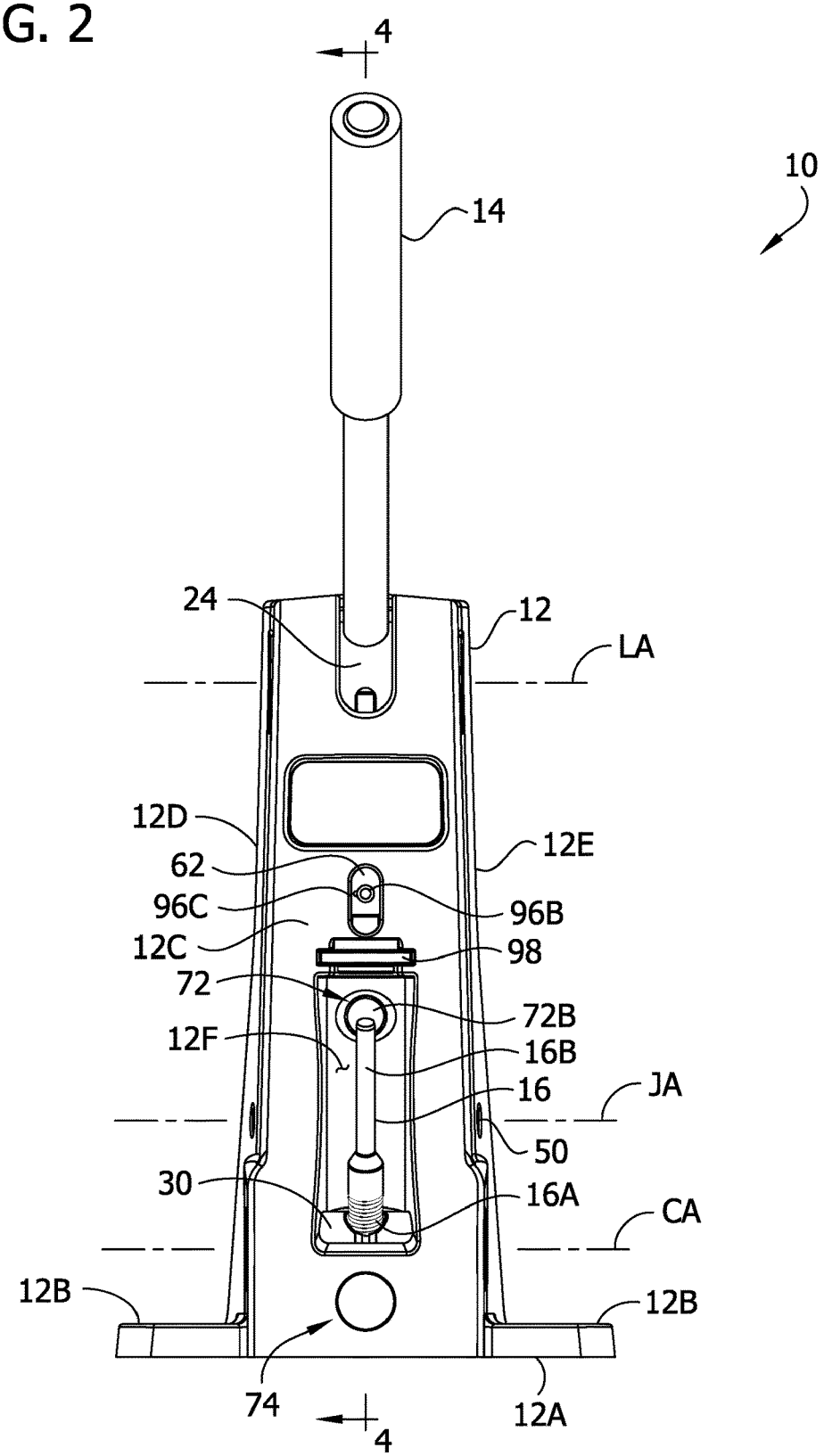
FIG. 2 is a front elevation of the primer pocket swager.
Figure 3:
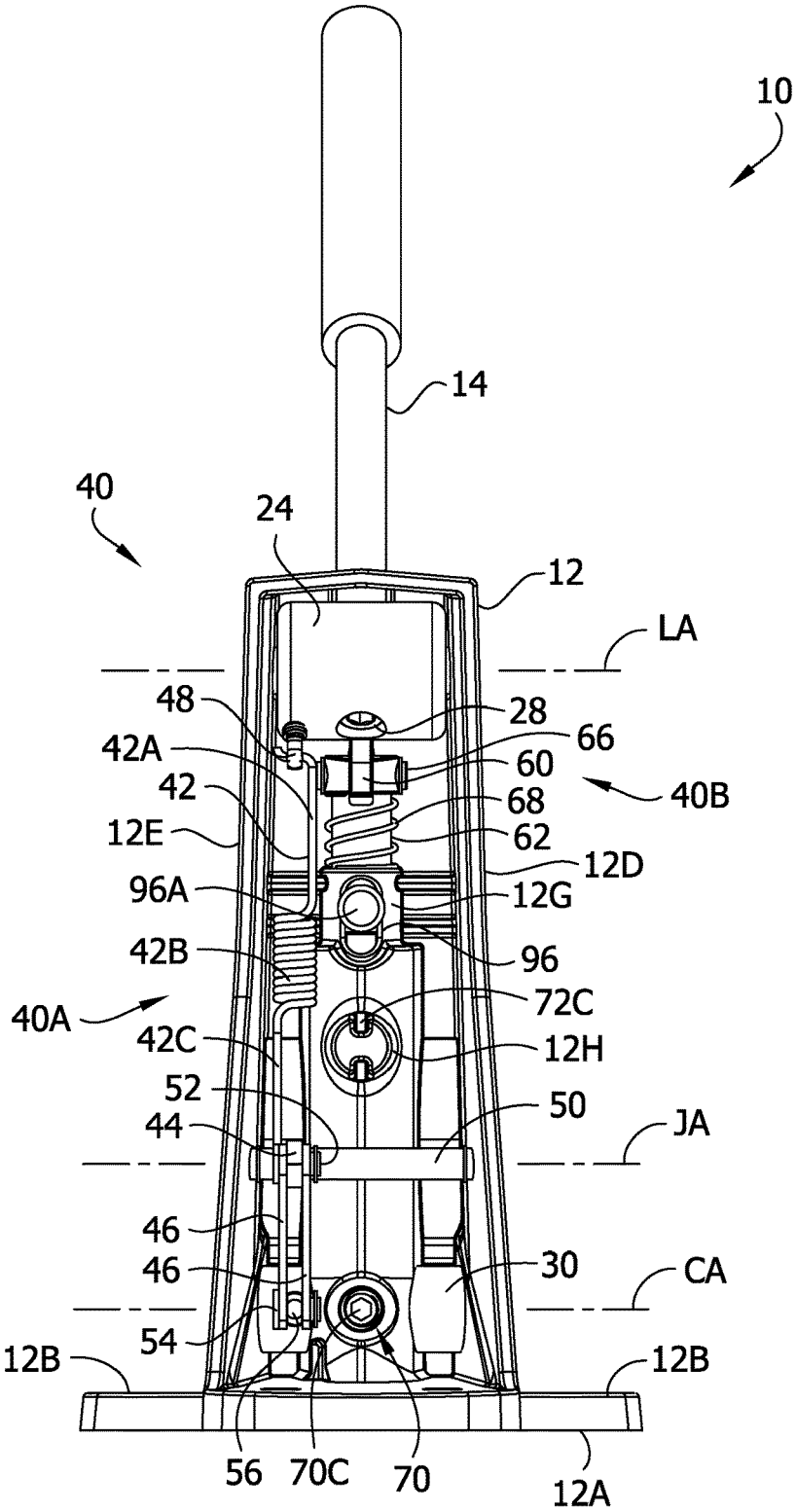
FIG. 3 is a rear elevation of the primer pocket swager.
Figure 3A:
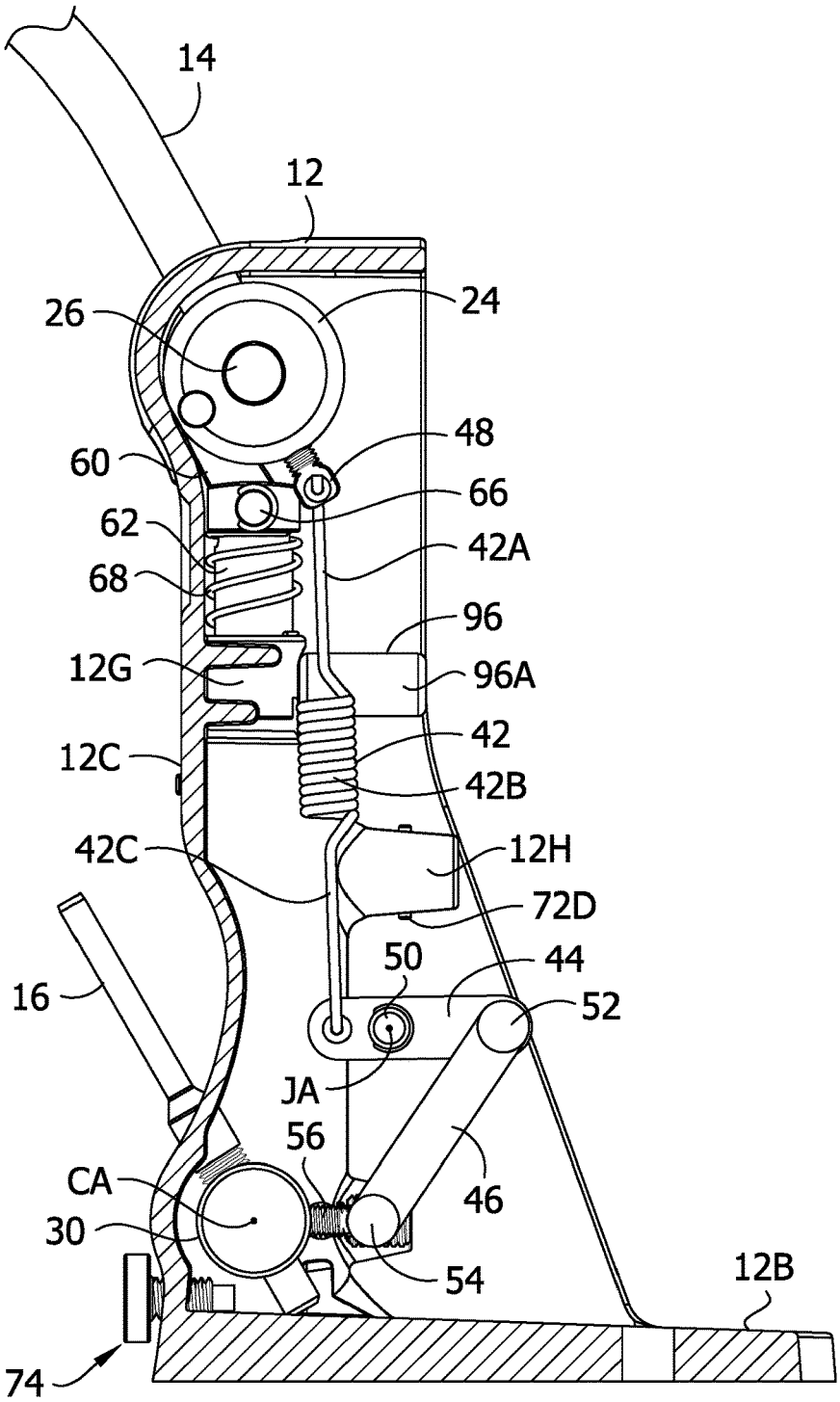
FIG. 3A is a side elevation of the primer pocket swager having a side wall broken away to expose internal components.

Referring to FIGS. 1-4, an ammunition case primer pocket swager is designated generally by the reference number 10. The swager 10 is configured to swage primer pockets of ammunition cases C (FIG. 4) to prepare the primer pockets for installation of new primers. As explained in further detail below, the swager 10 can be used to conveniently and efficiently swage primer pockets of a plurality of cases C in a relatively short amount of time. Components of the swager can be made of metal and/or plastic or any other suitable material.

In general, the swager 10 includes a frame 12, an actuator 14, a case holder 16, and a swage shaft 18. As will become apparent, a user installs a case C on the case holder 16 and then actuates the actuator 14. Movement of the actuator 14 in an actuating stroke causes the case holder 16 to move from a loading position (e.g., FIG. 4) to an operational position (e.g., FIGS. 5, 6) to locate the case C for swaging. Movement of the actuator in the actuating stroke also causes the swage shaft 18 to move downward to a swaging position (e.g., FIG. 6) swage the primer pocket. As explained further below, the swager 10 is configured to precisely position and orient the case C to achieve optimal and consistent swaging. In a return stroke of the actuator 14, the swage shaft 18 moves upward, and the case holder 16 moves from the operational position back to the loading position. In the loading position, the case holder 16 presents the swaged case C to the user for convenient unloading of the case and installation of another case to be swaged.

In the illustrated embodiment, the frame 12 is provided in the form of an upstanding housing. For example, the housing 12 can be formed of cast metal. The housing 12 supports the other components of the swager 10. The housing 12 includes a base and a superstructure extending upward from the base. The base defines a bottom 12A of the housing that is configured to rest on a surface such as a table top or other suitable surface. The base includes left, right, and rear wings 12B having respective fastener mounts 20 in the form of circular openings. For example, bolts, screws, or other fasteners (not shown) can be installed in the openings 20 to anchor the base to a suitable surface. The body includes a front wall 12C, left side wall 12D, and right side wall 12E, and an open rear exposing an interior of the housing. The front wall 12C defines a case receiving recess 12F into which the case holder 16 is movable to the operational position to carry a case C into position to be swaged. The actuator 14 and case holder 16 protrude forward in front of the front wall 12C, and several other components of the swager 10 are housed in the interior of the housing behind the front wall.

In the illustrated embodiment, the actuator 14 is provided in the form of a lever. The lever 14 includes a proximal end adjacent the housing 12 and a distal or free end spaced from the proximal end. The proximal end is secured to an upper pivot mount 24 at an upper end of the housing 12. The pivot mount 24 is pivotally connected to the housing 12 by a pin 26 and configured to pivot about a generally horizontal lever pivot axis LA defined by the pin 26. The proximal end of the lever 14 has a threaded bore and is received in a first side of the pivot mount 24. The lever 14 is secured to the pivot mount by a bolt 28 in the pivot mount 24 forming a threaded connection with the threaded bore of the lever. The lever 14 is shown in a home position in FIGS. 1-4. In the home position, the lever 14 extends forward and upward. The lever 14 is pivotable downward in an actuating stroke from the home position to an intermediate position (e.g., FIG. 5) and further to an actuated position (e.g., FIG. 6). The actuated position can vary based on the type of case C being swaged and the adjustment of various components of the swager 10. In the actuated position, the lever 14 extends forward. The arrangement is such that a user can grip the lever 14 in the home position by hand and conveniently pull downward to actuate the swager 10 by moving the lever from the home position to the actuated position. The lever 14 is movable in a return stroke from the actuated position back to the home position. Other types of actuators can be used without departing from the scope of the present invention.

Figure 4:
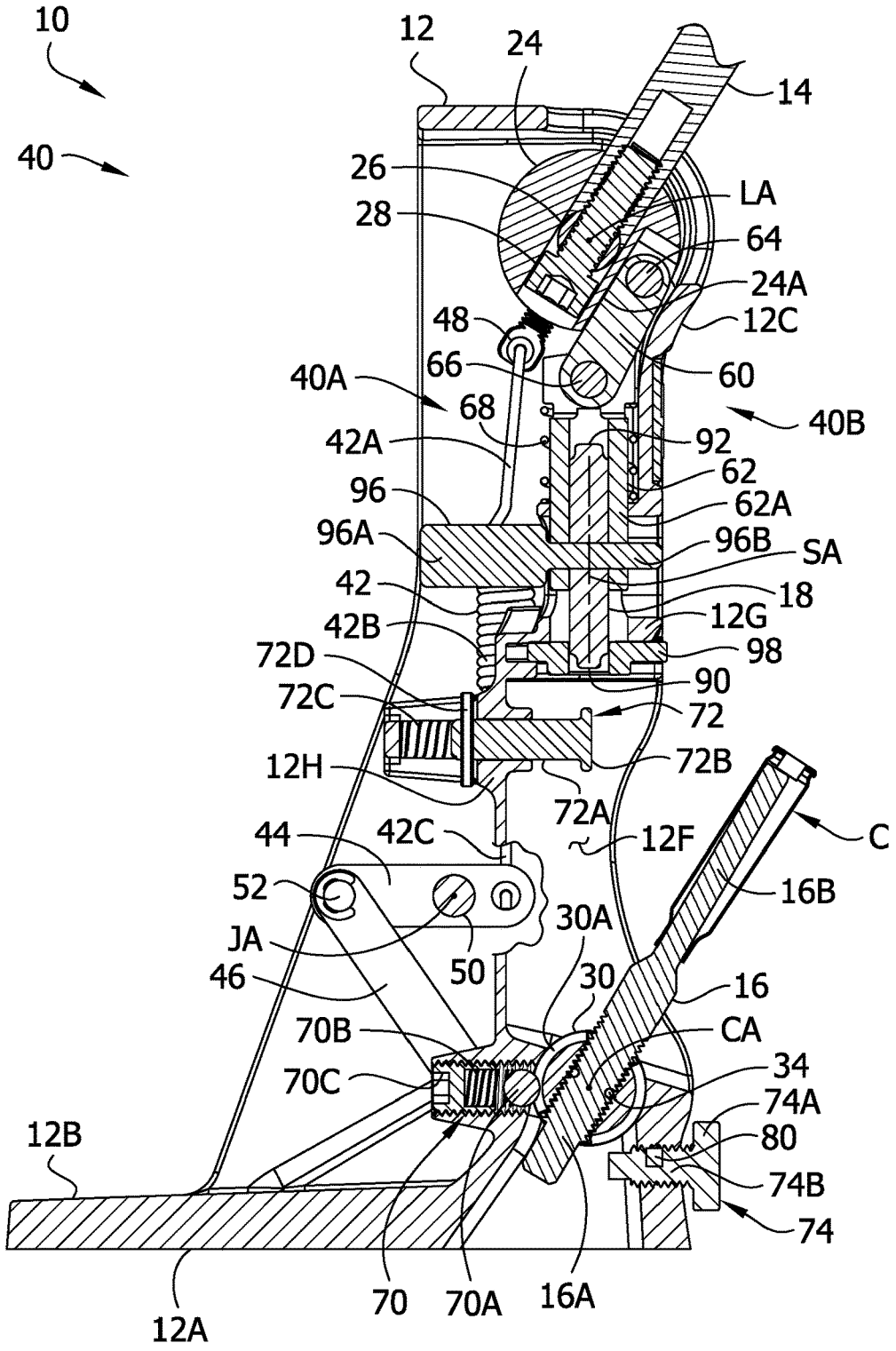
FIG. 4 is a vertical section of the primer pocket swager taken in a plane including line 4-4 of FIG. 3.

The case holder 16 includes a shaft having a threaded proximal portion 16A and a distal portion 16B. The distal portion is sized to receive a case C to be swaged by placing the mouth of the case over a tip of the distal portion 16B and sliding the case downward. The threaded portion 16A is secured to a lower pivot mount 30 having opposite ends received in openings 32 in the sides of the housing 12 pivotally connecting the lower pivot mount to the housing. The lower pivot mount 30 defines a pivot axis CA about which the lower pivot mount and the case holder 16 are conjointly pivotable. The case holder 16 is pivotable about the pivot axis CA between a loading position (e.g., FIGS. 1-4) and an operational position (e.g., FIGS. 5, 6). The threaded portion 16A of the case holder 16 is threaded into a threaded opening in the lower pivot mount 30. An O-ring 34 of resiliently compressible material is carried in a circumferential groove in the threaded portion 16A to create friction in the threaded opening of the pivot mount 30 to avoid rotation of the case holder 16 and maintain it in a desired position with respect to the pivot mount. The case holder 16 can be threaded into or out of the pivot mount 30 to set a depth to which the case's primer pocket will be swaged by the swage shaft 18. As shown in FIG. 4, when the case holder 16 is in the loading position, the case holder extends forward and upward and out of the case receiving recess 12F at an angle with respect to vertical. In the loading position, the case holder 16 is oriented to permit a user to conveniently access the distal portion 16B to load cases onto and unload cases from the case holder. The case holder 16 is pivotable to the operational position by actuation of the lever 14 to carry the case C into position to be swaged. Other types of case holders can be used without departing from the scope of the present invention.

Referring to FIGS. 3-6, the swager includes a drive linkage, generally indicated at 40, operationally connecting the lever 14 to the case holder 16 and operationally connecting the lever to the swage shaft 18 for driving movement of the case holder and swage shaft in a sequenced manner. The drive linkage 40 is located behind the front wall 12C and housed mostly in the interior of the housing 12. In the illustrated embodiment, the drive linkage 40 includes a first drive train 40A operationally connecting the lever 14 to the case holder 16 and a second drive train 40B operationally connecting the lever to the swage shaft 18. Both the first and second drive trains 40A, 40B include the upper pivot mount 24 from which the lever 14 extends. The first and second drive trains 40A, 40B branch from the upper pivot mount 24 downward toward the respective case holder 16 and swage shaft 18.

Figure 5:
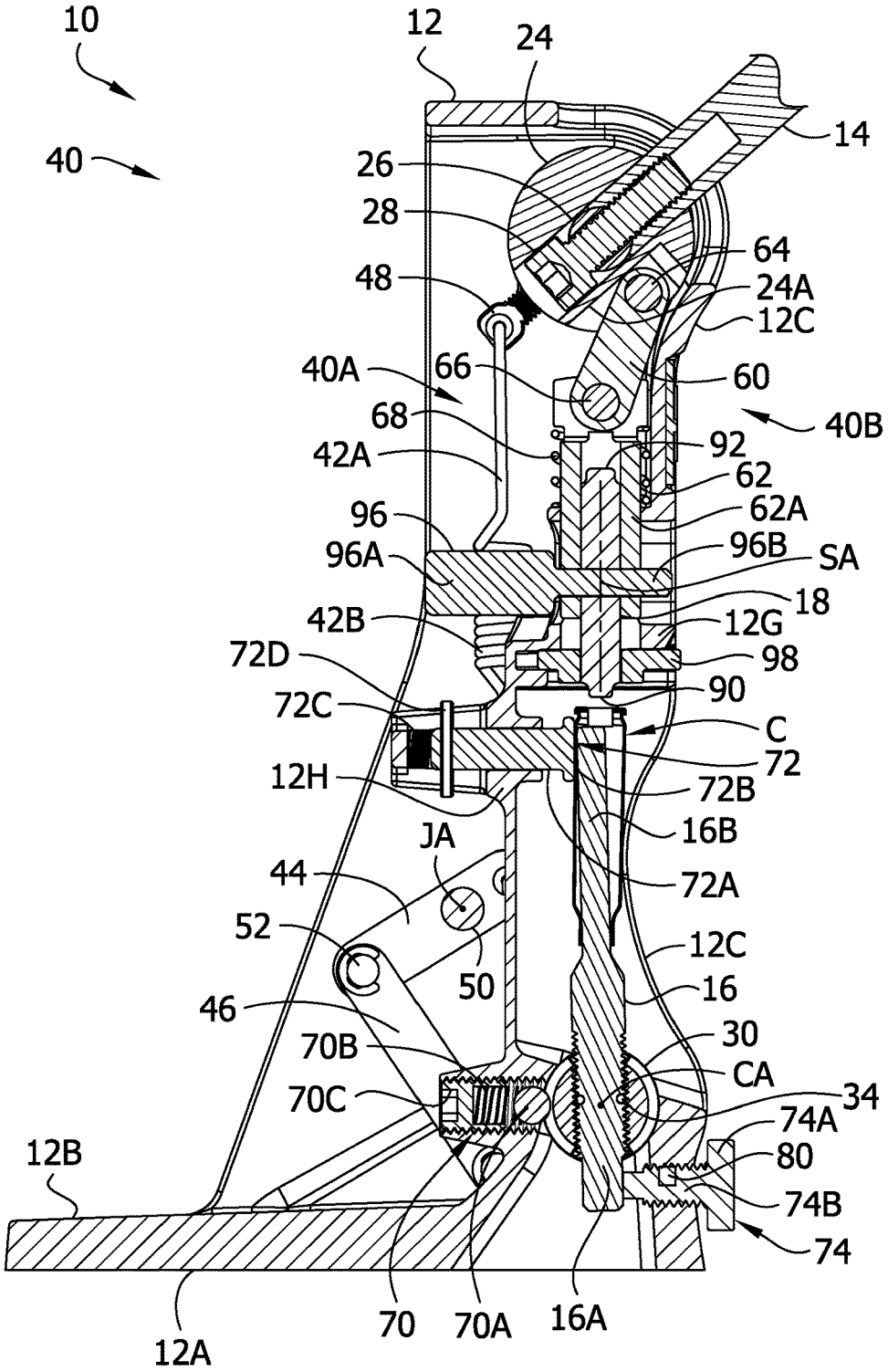
FIG. 5 is a view similar to FIG. 4 but showing the swager partially actuated.

Referring to FIGS. 4 and 5, the first drive train 40A further includes a first link 42, a second link 44, and a third link 46. The first drive train 40A also includes the lower pivot mount 30. The first link 42 is an extendable link (broadly, "lost motion link") and is provided in the form of an extension spring. The extension spring 42 includes an upper arm 42A, an intermediate coil portion 42B, and a lower arm 42C. For example, the extension spring 42 can be formed of a continuous piece of wire. The upper arm 42A includes a hook pivotally connecting the extension spring 42 to an eye bolt 48 threaded into the upper pivot mount 24. The intermediate coil portion 42B defines a helical winding having several turns. The lower arm 42C includes a hook pivotally connecting the extension spring to the second link 44. As explained in further detail below, the extension spring 42 is extendable from a retracted configuration (e.g., FIGS. 4, 5) to an extended configuration (e.g., FIG. 6) to create lost motion between the lever 14 and the case holder 16 when the case holder is in the operational position. In the retracted configuration, consecutive turns of the helical winding 42B engage and rest against each other. In the extended configuration, the helical winding 42B is extended such that the consecutive turns of the helical winding are spaced from each other. A forward end portion of the second link 44 is pivotally connected to the extension spring 42. An intermediate portion of the second link 44 is pivotally connected to the housing 12 by a pin or jack shaft 50 received in openings in the left and right side walls 12D, 12E of the housing 12. The second link 44 is pivotable about a jack shaft pivot axis JA extending along the length of the jack shaft 50. The third link 46 is provided in the form of two elongate bars (each indicated at 46) having upper ends on opposite sides of and pivotally connected to the rear end portion of the second link 44 by a pin 52. The two elongate bars 46 have lower ends pivotally connected by a pin 54 to an eye bolt 56 extending from the lower pivot mount 30. The eye bolt 56 is threaded into and conjointly pivotable with the lower pivot mount 30 like the eye bolt 48 is threaded into and conjointly pivotable with the upper pivot mount 24. As shown by comparison of FIGS. 4 and 5, the arrangement is such that pivoting of the lever 14 in the actuating stroke from the home position toward the actuated position causes the upper pivot mount 24 to rotate clockwise, which pulls the spring 42, creating tension force in the spring but not extending the spring, and causes the second link 44 to rotate counterclockwise about the jack shaft axis JA. The second link 44 pushes the third link 46, creating compression force in the third link between its pin connections, which causes the lower pivot mount 30 to rotate counterclockwise to move the case holder 16 from the loading position toward the operational position. Accordingly, the clockwise rotation of the upper pivot mount 24 is converted by the first drive train 40A to counterclockwise rotation of the lower pivot mount 30. As shown by comparison of FIGS. 4, 5, and 6, the first link 42 is in its retracted configuration and does not begin extending until the case holder 16 reaches the operational position. Desirably, the case holder 16 reaches the operational position when the lever 14 reaches an intermediate position (e.g., FIG. 5) in the actuating stroke between the home and actuated positions. As will become apparent, the extension of the spring 42 permits further pivoting of the lever 14 in the actuating stroke beyond the intermediate position to the actuated position so the second drive train 40B can drive the swage shaft 18 to swage the primer pocket while the first drive train 40A maintains the case holder 16 in the operational position.

In view of the above, it will be apparent that the first drive train 40A includes seven pivot connections. Three of the pivot connections are pin connections of the drive train 40A with the housing 12. In particular, the upper pivot mount 24 is pivotally connected to the housing 12, the jack shaft 50 pivotally connects the second link 44 to the housing, and the lower pivot mount 30 is pivotally connected to the housing. In other words, three of the pivot connections are fixed with respect to the housing 12. The other four pivot connections are movable with respect to the housing 12 responsive to movement of the lever 14. In particular, these include the pivot connections at the opposite ends of the spring 42, and the pivot connections at the opposite ends of the third link 46.

Referring still to FIGS. 4 and 5, the second drive train 40B will now be described in further detail. The second drive train 40B includes the upper pivot mount 24, a link 60, and a ram 62. The link 60 includes an upper end pivotally connected to the upper pivot mount 24 by a pin 64. A lower end of the link 60 is pivotally connected to the ram 62 by a pin 66. The ram 62 is received in a guide 12G defined by the housing 12. The ram 62 includes a lower sleeve 62A having a bore sized for receipt of the swage shaft 18. The swage shaft extends downward below the ram 62. A compression spring 68 surrounding the ram 62 has an upper end engaging an upper portion of the ram and has a lower end engaging an upper portion of the guide 12G. The compression spring 68 biases the ram 62 upward and is compressible to permit downward movement of the ram. As shown by comparison of FIGS. 4 and 5, the arrangement of the second drive train 40B is such that movement of the lever 14 in the actuating stroke from the home position toward the actuated position causes clockwise rotation of the upper pivot mount 24, which pushes on the link 60, creating compression force between its pin connections. The link 60 pushes the ram 62 and thus the swage shaft 18 downward for swaging the primer pocket of the case C. Accordingly, the second drive train 40B converts the rotational movement of the upper pivot mount 24 to translational or sliding movement of the ram 62 to move the swage shaft 18 between a retracted position (e.g., FIG. 4) and a swaging position (e.g., FIG. 6). As shown by comparison of FIGS. 4 and 5, the second drive train 40B initially moves the swage shaft 18 downward while the first drive train 40A moves the case holder 16 to the operational position. As shown by comparison of FIGS. 5 and 6, the second drive train 40B continues to move the swage shaft 18 downward after the first drive train 40A moves the case holder 16 to the operational position and while the first drive train maintains the case holder in the operational position. Desirably, as the lever 14 approaches the actuated position and the swage shaft 18 approaches its swaging position, the pivot connection of the second drive train link 60 to the upper pivot mount 24 moves "over center" with respect to the pivot axis LA of the upper pivot mount to provide mechanical advantage in swaging the primer pocket and provide a reduction of pressure felt by the user in moving the lever downward. In particular, as the shaft 18 approaches the swaging position, the pivot axis defined by the pin 64 approaches and/or crosses a line extending between the pivot axis LA defined by the pin 26 and the pivot axis defined by the pin 66.

In view of the above, it will be appreciated that the second drive train 40B includes three pivot connections. One of the pivot connections is a pin connection of the upper pivot mount 24 with the housing 12. This pivot connection is fixed with respect to the housing 12. The other two pivot connections, i.e., the pivot connections at the opposite ends of the link 60, are movable with respect to the housing 12 response to movement of the lever 14.

It will be appreciated that the ram spring 68 biasing the ram 62 upward with respect to the ram guide 12G also biases the lever 14 toward and maintains the lever in its home position and biases the case holder 16 toward and maintains the case holder in its loading position. When a user is not applying downward force on the lever 14, the lever is biased upward by the ram spring 68 via the second drive train 40B. In particular, referring to FIG. 4, the spring 68 pushes upward on the ram 62, which pushes upward on the link 60 and tends to rotate the upper pivot mount 24 counterclockwise. This in turn, via the first drive train 40A, tends to rotate the lower pivot mount 30 clockwise. The lever 14 is located in its home position, and the case holder 16 is located in its loading position, by engagement of a side of the second drive train link 60 with a flat 24A on the upper pivot mount 24. It will be appreciated that if the spring 42 were not in its retracted configuration when the lever 14 is in the home position, tension in the spring 42 would tend to move the case holder 16 toward the operational position.

Other drive linkages operatively connecting the lever 14 to the case holder 16 and/or the swage shaft 18 can be used without departing from the scope of the present invention. For example, the lost motion link may be configured to retract rather than to extend for providing the lost motion. Moreover, other types of drive trains having other types of links are possible.

The swager 10 includes several features that assist in properly aligning the case C with the swage shaft 18 for optimal and consistent swaging. For example, the swager 10 includes a pivot mount rotation guide 70, a case aligner 72, and a case holder stop 74. As explained in further detail below, the pivot mount rotation guide 70 promotes the case holder 16 to move in an arcuate path that is coplanar with a swaging axis SA of the swage shaft 18. As also explained in further detail below, the case aligner 72 and case holder stop 74 serve to align the primer pocket of the case C with the swaging axis SA of the swage shaft 18.

Referring to FIG. 4, the pivot mount rotation guide 70 includes a ball bearing 70A, a spring 70B, and an actuator in the form of a set screw 70C. The ball bearing 70A, the spring 70B, and the set screw 70C are all received in an opening in the housing 12 adjacent the lower pivot mount 30. The set screw 70C is threaded in the opening and serves as an adjustable backing for the spring 70B, which biases the ball bearing 70A against the lower pivot mount 30. The lower pivot mount 30 includes a circumferential arcuate slot 30A facing the ball bearing 70A. The arcuate slot 30A is rectangular in section and has left and right arcuate edges at opposite sides of the slot extending circumferentially around the lower pivot mount 30 at its outer surface. The arcuate slot 30A can be referred to as a track, and the ball bearing 70A can be referred to as a follower on the track. In response to rotation of the lower pivot mount 30, the ball bearing 70A rides on the left and right edges of the track 30A. Pressure of the ball bearing 70A against the track 30A can be adjusted by threading the set screw 70C toward or away from the lower pivot mount 30. The arrangement is such that the pivot mount rotation guide 70 promotes rotation of the lower pivot mount 30 about the axis CA perpendicular to the swage shaft axis SA and thus promotes movement of the case holder 16 in an arcuate path coplanar with the swage shaft axis SA. In other words, the bias of the ball bearing 70A against the lower pivot mount 30 "bottoms out" the opposite ends of the lower pivot mount 30 in forward ends of the openings 32 in housing 12, to take out any looseness or slop of the pivot connection of the lower pivot mount and the housing. This promotes alignment of the case holder 16 left to right with respect to the swage shaft 18 when the case holder 16 is in the operational position. Case holder mounts having other configurations can be used without departing from the scope of the present invention. Moreover, the pivot mount guide can have other configurations or be omitted.

The case aligner 72 is provided in the form of a case pusher arranged to push against the case C when the case holder 16 is in the operational position. The case pusher 72 includes a plunger 72A having a head 72B defining a case engagement surface. The plunger 72A is slidable in a plunger guide 12H defined by the housing 12 and is biased forward by a spring 72C. A fastener 72D (e.g., roll pin) extending through a distal end of the plunger 72A engages the plunger guide 12H to limit forward movement of the plunger. The arrangement is such that as the case holder 16 approaches the operational position (e.g., FIG. 5), the plunger 72A contacts the case C, and in response to movement of the case, the plunger moves rearward and compresses the spring 72B. The force of the plunger 72A on the case C causes the inside curved surface of the case side wall to abut the outer curved surface of the case holder 16. This centers the case C left to right on the case holder 16 with respect to the housing 12. Other types of case aligners can be used, or the case aligner can be omitted, without departing from the scope of the present invention.

Figure 6:
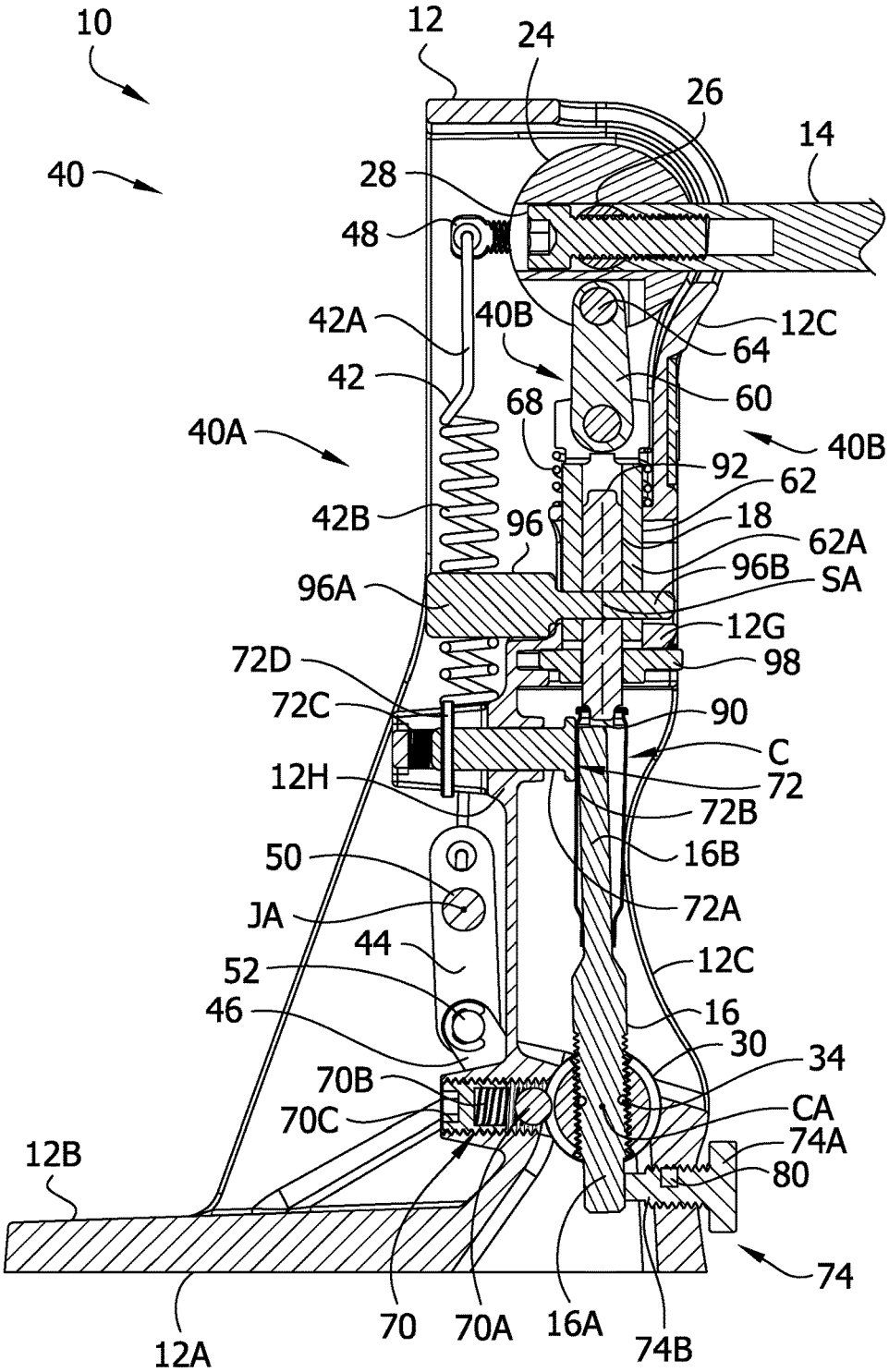
FIG. 6 is a view similar to FIG. 4 but showing the swager fully actuated.

In the illustrated embodiment, the case holder stop 74 is provided in the form of a thumb screw including a head or knob 74A and a threaded shaft 74B. The threaded shaft 74B is received in a threaded opening in the lower end of the housing 12. The shaft 74B includes a distal end positioned to engage the case holder 16 to locate the case holder in its operational position. As shown in FIGS. 5 and 6, the distal end of the shaft 74B (broadly, "stop surface") engages a portion of the case holder 16 protruding below the lower pivot mount 30 when the case holder is in the operational position. In the actuating stroke of the lever 14, when the bottom end of the case holder 16 engages the case holder stop 74, the first drive train 40A is prevented from further rotating the lower pivot mount 30, and further movement of the lever toward the actuated position causes extension of the spring 42. The operational position of the case holder 16 can be precisely adjusted by threading the case holder stop 74 into or out of the housing 12. A retainer 80 (e.g., elastomeric pad or O-ring) is carried by the threaded shaft 74B and interrupts the threads of the shaft to create friction against the housing 12 to prevent inadvertent rotation of the threaded shaft 74B and maintain the case holder stop 74 in a desired position. The case holder stop 74 permits precise front to back adjustment of the case holder 16 with respect to the swage shaft 18. It will be appreciated that in the operational position, the longitudinal axis of the case holder 16 is not necessarily aligned with the longitudinal axis of the swage shaft 18. As shown in FIGS. 5 and 6, the longitudinal axis of the case holder 16 may point rearward such that the case C pushed forward on the case holder by the case aligner 72 has its primer pocket in alignment with the longitudinal axis of the swage shaft 18. Other types of case holder stops can be used, or the case holder stop can be omitted, without departing from the scope of the present invention.

In an aspect of the present disclosure, the swager 10 can be configured to swage cases having different mouth sizes. The swager 10 can be provided with a set of interchangeable case holders 16, 116 for use with cases having different mouth sizes. In the illustrated embodiment, a set of two case holders 16, 116 is provided. The first case holder 16 is shown installed on the swager in FIGS. 1-6. The first case holder 16 can be used for cases having relatively small case mouths. The second case holder 116 is shown installed on the swager in FIG. 7. The second case holder 116 has a similar construction to the first case holder 16. For example, the second case holder 116 includes a threaded proximal end portion 116A and a distal end portion 116B configured to receive a case. An O-ring 134 is carried by the threaded end portion 116A to create friction at the threaded connection of the case holder 16 and the lower pivot mount 30. The second case holder 116 has a larger diameter distal end portion 116B and can be used for cases having relatively large case mouths.

Figure 7:
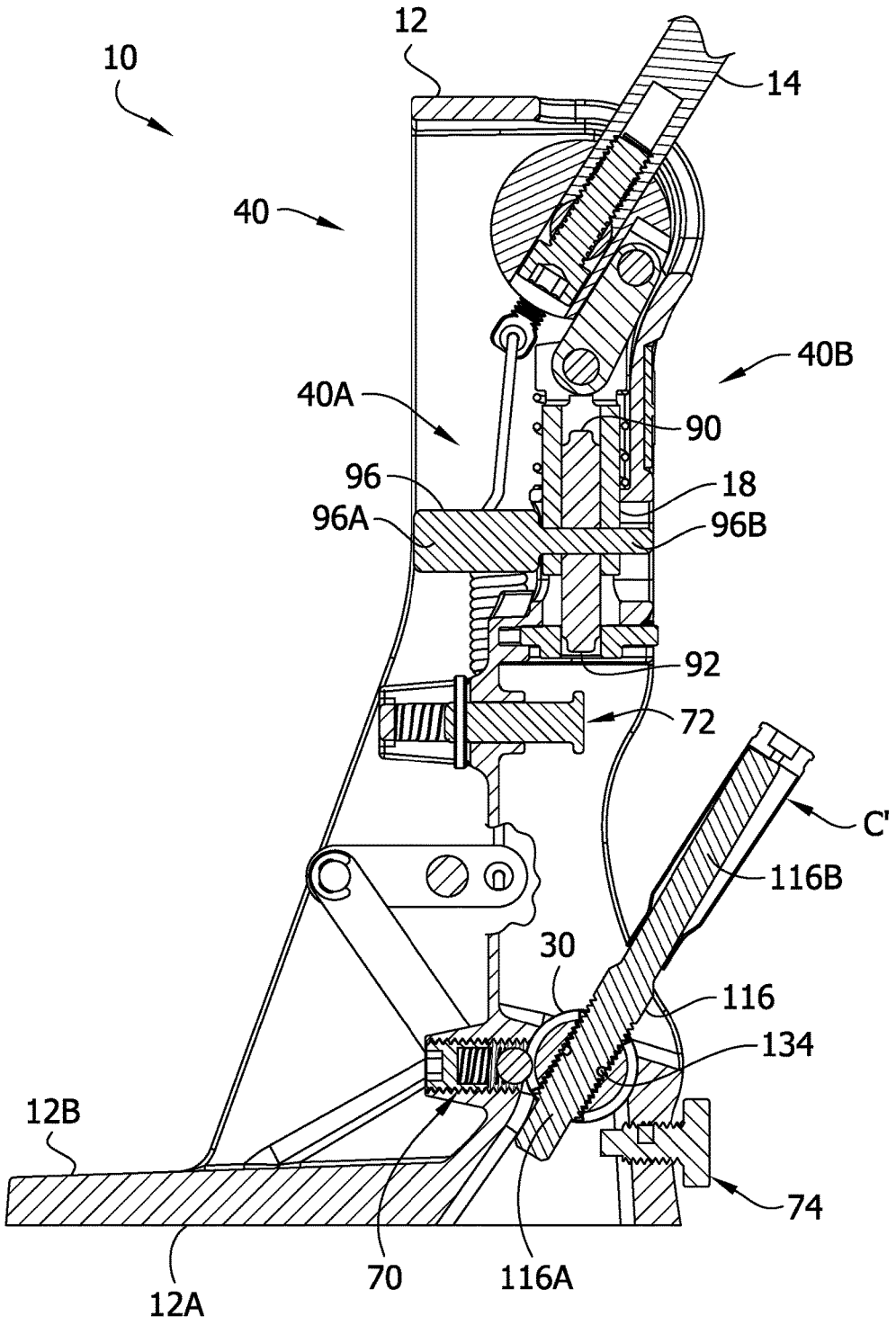
FIG. 7 is a view similar to FIG. 4 but showing the swager configured for swaging a larger primer pocket than in FIG. 4.

In another aspect of the present disclosure, the swager 10 can be configured to swage cases C having different sizes of primer pockets. In the illustrated embodiment, the swager shaft 18 includes first and second swage heads 90, 92 at opposite ends of the swaging shaft. In FIGS. 1-6, the first swage head 90 is positioned for swaging a case C on the case holder 16, and the second swage head 92 is in storage in the ram 62. The first swage head 90 is configured to swage relatively small primer pockets, and the second swage head 92 is configured to swage relatively large primer pockets. A case C' having a larger primer pocket is shown in FIG. 7. Each swage head 90, 92 includes a generally cylindrical protrusion surrounded by an annular shoulder where the cylindrical protrusion connects to a main body of the shaft 18. The swage shaft 18 is releasably secured to the ram 62 by a retainer 96 including a handle 96A and a pin 96B. The pin 96B extends through aligned openings in the ram 62 and the swage shaft 18. The retainer 96 is releasably maintained in the ram 62 by a ball detent 96C (FIG. 2) protruding laterally from a side of a distal end of the pin 96B. A user can change which swage head 90, 92 is positioned for use by pulling the handle 96A of the retainer 96 rearward. When sufficient force is applied, the ball detent 96C retracts into the pin 96B of the retainer 96, and the pin can be withdrawn from the ram 62 and swage shaft 18. The swage shaft 18 can then be dropped down out of the ram 62, and inverted and repositioned in the ram with the other swage head 92 pointing downward for swaging. Reinstallation of the retainer 96 secures the swage shaft 18 in this inverted configuration in the ram 62.

The swage head 90, 92 may become lodged in a primer pocket such that the case C moves upward with the swage shaft 18 in the return stroke of the lever 14. A replaceable extractor 98 is provided to engage the primer pocket end of the case C and permit the swage head 90, 92 to be withdrawn from the primer pocket. The extractor 98 is releasably mounted on the housing 12 by receipt in a slot in the front of the housing. The swage shaft 18 extends through an opening in the extractor sized slightly larger than the swage shaft. A case C stuck on the swage head 90, 92 would engage the extractor 98 to remove the case from the swage head and drop the case back onto the case holder 16.

In a method of using the swager 10, the user selects which swage head 90, 92 and case holder 16, 116 are appropriate for a particular type of case C to be swaged. After the desired swage head 90, 92 is positioned for swaging, and the desired case holder 16, 116 is installed, a sample case C, C' is loaded on the case holder 16 (e.g., FIG. 4). The user moves the lever 14 in the actuating stroke to move the case holder 16 to the operational position (e.g., FIG. 5). The user can observe the alignment of the primer pocket with respect to the swage head 90, 92. If necessary, the user can thread the case holder stop 74 into or out of the housing 12 to adjust the front to back alignment of the primer pocket with respect to the swage head 90. Moreover, the case holder 16 can be threaded into or out of the lower pivot mount 30 to raise or lower the case C, C' for selecting a depth the swage shaft 18 enters the primer pocket in the swaging position (e.g., FIG. 6). A few cases C, C' may be swaged and inspected to determine whether the desired swage is being achieved. Final adjustments can be made if desired. Thereafter, the user can quickly and conveniently load, swage, and unload many cases C, C' in a convenient and efficient manner. In the actuating stroke, the lever 14 drives the case holder 16 to the operational position and drives the swage head 90, 92 to the swaging position. In the return stroke, the lever 14 and/or ram spring 68 drives the case holder 16 to the loading position and drives the swage head 90, 92 to its retracted position. The downward actuating stroke of the lever 14 is ergonomic, and the automatic movement of the case holder 16 between the loading and operational positions by the lever and/or ram spring 68 makes use of the swager 10 convenient and efficient.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A primer pocket swager for swaging a primer pocket of an ammunition case, the primer pocket swager comprising:

a frame, a case holder supported by the frame, the case holder movable with respect to the frame between a loading position and an operational position, the case holder in the loading position being oriented to receive the case on the case holder, the case holder in the operational position being oriented to hold the case in position to be swaged, the case holder being configured to carry the case from the loading position to the operational position;

a swage head supported by the frame, the swage head sized and shaped to swage the primer pocket of the case, the swage head being movable between a retracted position and a swaging position to swage the primer pocket when the case holder is in the operational position; and an actuator supported by the frame, the actuator movable with respect to the frame in an actuating stroke from a home position to an actuated position, the actuator being operatively connected to the case holder such that the actuator drives the case holder to the operational position in the actuating stroke, the actuator being operatively connected to the swage head such that the actuator drives the swage head to the swaging position to swage the primer pocket.

2. The primer pocket swager as set forth in claim 1, further comprising a drive train operatively connecting the actuator to the case holder to drive the case holder to the operational position, the actuator being arranged with respect to the drive train to, in the actuating stroke, create force in the drive train that moves the drive train to drive the case holder to the operational position.

3. The primer pocket swager as set forth in claim 2, wherein the drive train includes at least one link operatively connecting the actuator to the case holder to drive the case holder to the operational position, the drive train arranged to create tension or compression in said at least one link in response to movement of the actuator in the actuating stroke to drive the case holder to the operational position.

4. The primer pocket swager as set forth in claim 3, wherein said at least one link has two pivot connections movable with respect to the housing responsive to movement of the actuator in the actuating stroke.

5. The primer pocket swager as set forth in claim 3, wherein the at least one link has a pin connection about which the at least one link pivots with respect to the housing responsive to movement of the actuator in the actuating stroke.

6. The primer pocket swager as set forth in claim 5, wherein the actuator is arranged to drive said pin connection to move with respect to the housing in response to movement of the actuator in the actuating stroke.

7. The primer pocket swager as set forth in claim 2, wherein the drive train includes at least one link arranged to be pushed by the drive train responsive to movement of the actuator in the actuating stroke.

8. The primer pocket swager as set forth in claim 2, wherein the drive train includes a lost motion link configured to create lost motion between the actuator and the case holder in response to movement of the actuator in the actuating stroke.

9. The primer pocket swager as set forth in claim 8, wherein the lost motion link is configurable in a retracted configuration and in an extended configuration, the lost motion link having a shorter length in the retracted configuration than in the extended configuration, the lost motion link being arranged to extend from the retracted configuration to the extended configuration in response to movement of the actuator in the actuating stroke.

10. The primer pocket swager as set forth in claim 9, wherein the lost motion link is configured to remain in the retracted configuration in response to movement of the actuator in a first movement range of the actuator, and the lost motion link is configured to extend to the extended configuration in response to movement of the actuator in a second movement range of the actuator.

11. The primer pocket swager as set forth in claim 2, wherein the actuator is movable in the actuating stroke from the home position to an intermediate position between the home and actuated positions to drive the case holder to the operational position, the actuator being movable in the actuating stroke beyond the intermediate position to the actuated position to the actuated position to drive the swage head to the swaging position.

12. The primer pocket swager as set forth in claim 11, wherein the drive train includes a lost motion link configured to create lost motion between the actuator and the case holder in response to movement of the actuator in the actuating stroke, the lost motion link being configurable in a retracted configuration and in an extended configuration, the lost motion link having a shorter length in the retracted configuration than in the extended configuration, the lost motion link arranged to maintain at least one of the retracted and extended configurations in response to movement of the actuator in the actuating stroke from the home position to the intermediate position, and the lost motion link arranged to change from said at least one of the retracted and extended configurations to the other of the retracted and extended configurations in response to movement of the actuator in the actuating stroke from the intermediate position to the actuated position.

13. The primer pocket swager as set forth in claim 2, further comprising a case holder stop supported by the frame, the frame having a threaded opening, the case holder stop including a threaded shaft and a stop surface positioned to engage at least one of the case holder and the drive train to locate the case holder in the operational position, the threaded shaft forming a threaded connection with the threaded opening and being rotatable in the threaded opening to change a position of the stop surface to change the operational position of the case holder.

14. The primer pocket swager as set forth in claim 1, wherein the frame is generally upstanding and includes a top and a bottom, the bottom being configured to rest on a surface for supporting the frame on the surface, and wherein when the bottom is resting on the surface, the case holder in the loading position extends laterally and upward at an angle with respect to vertical and the case holder in the operational position extends more upward than in the loading position.

15. The primer pocket swager as set forth in claim 1, wherein the case holder includes a shaft portion shaped and sized to fit in a mouth of the case to install the case on the case holder.

16. The primer pocket swager as set forth in claim 1, further comprising a spring supported by the frame, the spring biasing the case holder toward the loading position.

17. The primer pocket swager as set forth in claim 16, wherein the spring biases the actuator toward the home position.

18. The primer pocket swager as set forth in claim 16, wherein the spring biases the swage head toward the retracted position.

19. The primer pocket swager as set forth in claim 1, further comprising a pivot mount supported by and pivotable with respect to the frame, the case holder being secured to the pivot mount, and the primer pocket swager further comprising a pivot mount guide including a follower biased against the pivot mount, the follower configured to ride a track on the pivot mount responsive to pivoting of the pivot mount.

20. A primer pocket swager for swaging a primer pocket of an ammunition case, the primer pocket swager comprising:

a frame, a case holder supported by the frame, the case holder configured to hold the case in position to be swaged;

a swage shaft supported by the frame, the swage shaft having a first swage head located at a first end of the swage shaft and having a second swage head smaller than the first swage head located at a second end of the swage shaft opposite the first end, the swage shaft being movable from a retracted position to a swaging position, at least one of the first and second swage heads being oriented to swage the primer pocket when the swage shaft is in the swaging position, the swage shaft being reversible to orient the other of the first and second swage heads to swage the primer pocket; and an actuator supported by the frame, the actuator movable with respect to the frame in an actuating stroke from a home position toward an actuated position, the actuator operatively connected to the first swage head such that movement of the actuator in the actuating stroke drives the swage shaft toward the swaging position to swage the primer pocket.

21. A primer pocket swager for swaging a primer pocket of an ammunition case, the primer pocket swager comprising:

a frame, a pivot mount supported by and pivotable with respect to the frame, the pivot mount including a track;

a case holder secured to the pivot mount, the case holder configured to hold the case in position to be swaged;

a pivot mount guide including a follower biased against the pivot mount, the follower configured to ride the track on the pivot mount responsive to pivoting of the pivot mount;

a swage head supported by the frame, the swage head being movable from a retracted position to a swaging position and configured to swage the primer pocket in the swaging position; and an actuator supported by the frame, the actuator movable with respect to the frame and operatively connected to the swage head to drive the swage head toward the swaging position to swage the primer pocket.

* * * * *